US005314251A

United States Patent [19]

Taylor

[11] Patent Number: 5,314,251

[45] Date of Patent: May 24, 1994

[54] DEPOSIT ENVELOPE

[76] Inventor: William A. Taylor, 1685 Bucksglen Dr., Columbus, Ohio 43119

[21] Appl. No.: 912,725

[22] Filed: Jul. 13, 1992

[51] Int. Cl.[5] ..... B65D 33/04

[52] U.S. Cl. ..... 383/106; 229/71

[58] Field of Search ..... 383/37, 106; 229/69, 229/71; 150/145

[56] References Cited

U.S. PATENT DOCUMENTS

| | | | |
|---|---|---|---|
| 3,147,789 | 9/1964 | Paulson | 229/71 X |
| 3,979,051 | 9/1976 | Close | 150/145 X |
| 4,308,988 | 1/1982 | Jiveman et al. | 229/71 X |
| 4,615,480 | 10/1986 | Powell | 229/71 |
| 4,898,322 | 2/1990 | Coffey et al. | 229/69 |
| 4,934,587 | 6/1990 | McNabb | 229/71 |
| 5,071,061 | 12/1991 | Willis | 229/71 X |

FOREIGN PATENT DOCUMENTS

| | | | |
|---|---|---|---|
| 2397339 | 3/1979 | France | 229/71 |

*Primary Examiner*—Allan N. Shoap
*Assistant Examiner*—Jes F. Pascua
*Attorney, Agent, or Firm*—Biebel & French

[57] ABSTRACT

An improved deposit envelope comprising front and rear panels. The front panel comprises first and second designation areas, and first and second designations respectively. The front panel partially overlays the rear panel and is secured along its side edges and bottom edge to the rear panel. At least one aperture is formed in both the front and rear panels with such apertures being aligned with one another. Preferably the apertures are located along the vertical center lines of both front and rear panels. Alternative embodiments of the deposit envelope are disclosed.

21 Claims, 4 Drawing Sheets

DEPOSIT ENVELOPE

BACKGROUND OF THE INVENTION

The present invention relates generally to envelopes, and more particularly, to an improved deposit envelope.

Convenience stores, service stations, and other retail establishments often transact a substantial amount of business necessitating the need for the frequent storage of cash deposits. These deposits often cannot be taken from the place of operation to a banking establishment either due to the lateness of the hour or just because of the efficient utilization of worker time. Consequently, these establishments typically utilize some kind of a receptacle for the temporary storage of cash deposits.

In an effort to deter crime, many such establishments utilize drop safes. These receptacles permit the deposit thereinto of cash. While it is possible to merely empty the cash into the drop safe, the need for an orderly accountability of such cash deposits has resulted in the need to retain individual cash deposits together.

Up until this time, there have been two primary means to retain cash deposits together. The first means has been through the use of rubber bands, string, or other clipping or wrapping mechanisms. The problem with the above means for retaining cash deposits is that some, if not all, of the deposit may become separated from the rest of the deposit either during transmission through a tube or slot into the drop safe, or through the impact of the deposit in the drop safe, or the impact of subsequent deposits upon already dropped deposits.

The second means for making these deposits has been through the utilization of paper envelopes, of the type typically used in mailing letters. Under this approach, the cash deposit is placed in a paper envelope, which paper envelope is then either sealed or just dropped into the safe.

Numerous inventions have been made concerning envelopes. Some even have included provision for apertures formed in at least one panel of the envelope. Examples of this are Daly, U.S. Pat. No. 3,856,198 and Templet, U.S. Pat. No. 4,951,863. Daly discloses an interoffice envelope with apertures formed adjacent the side edges of the envelope. A flap 14 is provided for inter-engagement of cooperative retention means 22 and 23 thereby totaling enclosing the contents of the interoffice envelope. Templet discloses a double envelope construction for facsimile handling. The double envelope permits the insertion of a facsimile or copy into one of two pockets formed in the double envelope. Space is provided on the outer flap of the envelope to indicate who the facsimile is for or from as well as other information which may be pertinent to the user.

Several problems exist with using paper envelopes. First, they have a tendency to tear and jam up in drop safes. This tendency towards tearing and jamming is complicated if the envelopes are reused, such that the paper itself becomes weakened. An additional problem occurs if the envelope is not sealed, since spillage of the contents is made easier. A third drawback to the use of paper envelopes exists in the fact that they are not reusable, if sealed. This requires the stocking of sufficient envelopes to account for shift-by-shift and often cashier-by-cashier depositing of the envelopes.

Although none of the above methods are completely satisfactory, heretofore there has been no other apparatus available to store owners which holds funds securely thereby preventing scatter and which permits the orderly accountability of cash deposits. For example, even with the above mentioned means for making cash deposits, none of those discussed permit a store owner to easily ascertain what cash deposit corresponds with a particular shift or cashier.

It is thus apparent that the need exists for an improved deposit envelope which permits a more orderly accountability of cash deposits by cashiers.

SUMMARY OF THE INVENTION

The problems associated with prior methods for making cash deposits are overcome in accordance with the present invention by forming an improved deposit envelope. The improved deposit envelope is formed of two sheets of plastic secured on at least three sides to one another to form an envelope. The one sheet is of a lesser height than the other, so that the top edge of the one sheet extends above the top edge of the sheet of lesser height.

The deposit envelope of this invention preferably has a plurality of apertures formed therein, and more preferably these apertures are located along the vertical center line of both the front and rear panels. In addition to first and second designation areas on the front panel, preferably the deposit envelope of this invention also comprises a first and second designation in the respective first and second designation areas. Also, preferably both front and rear panels are rectangularly shaped.

In the preferred embodiment of the invention, the rear panel has a notch-like indentation formed along its top edge. More preferably this notch-like indentation is located along the rear panel's vertical center line.

There is also disclosed, in combination, a plurality of improved deposit envelopes each of which comprises a front panel having a first designation area and a second designation area, a top edge, a bottom edge spaced apart from the top edge a first distance, two side edges and at least one aperture. Each deposit envelope also comprises a rear panel having a top edge, a bottom edge spaced apart from the top edge a second distance with the second distance being greater than the first distance, two sides edges, and at least one aperture. The front panel aperture is aligned with the rear panel aperture.

Both the front and rear panels have a vertical center line with the front and rear panel apertures being preferably located along these center lines. The front panel is secured its sides to the rear panel. The deposit envelopes are labeled in the first and second designation areas so as to designate up to two factors associated with the deposit, with these factors comprising the time of the deposit, the person responsible for the deposit, and the place responsible for the deposit.

It is a primary object of the present invention to provide an improved deposit envelope for use preferably in connection with drop safes, which improved deposit envelope is conveniently and inexpensively formed, yet which provides secure yet visible storage of cash deposits.

Another objective of the present invention is to provide deposit envelopes which assist in the orderly accountability of cash deposits made by cashiers over a period of time.

Still another objective is to provide deposit envelopes which securely retain cash deposits and preclude scatter.

Other objects and advantages of the present invention will be apparent from the following description, the accompanying drawings, and the appended claims.

DETAILED DESCRIPTION OF THE INVENTION

Figure 1:
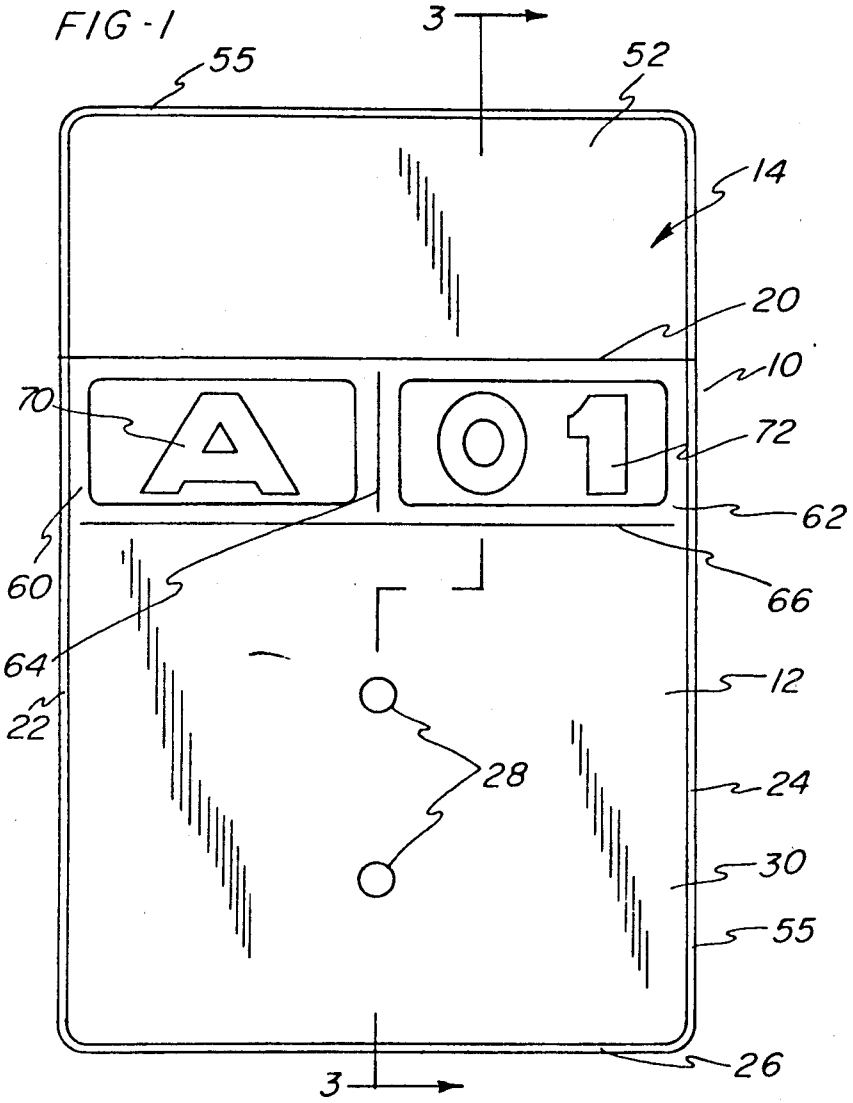
FIG. 1 is a front elevational view of an improved deposit envelope made in accordance with the present invention.

Having reference to the drawings, attention is directed first to FIG. 1, which discloses a front plan view of an improved deposit envelope made in accordance with the invention designated generally by the numeral 10. The improved deposit envelope 10 is comprised of a front panel 12 and a rear panel 14.

The front panel 12 is comprised of a top edge 20, side edges 22 and 24, and bottom edge 26. Preferably the top edge 20 and the bottom edge 26 are parallel with respect to one another, as are side edges 22 and 24. The front panel 12 also includes at least one aperture 28, with the front panel preferably including at least two apertures 28 as shown. The front panel also comprises exterior surface 30 and interior surface 32, with the interior surface 32 laying adjacent rear panel 14.

Figure 2:
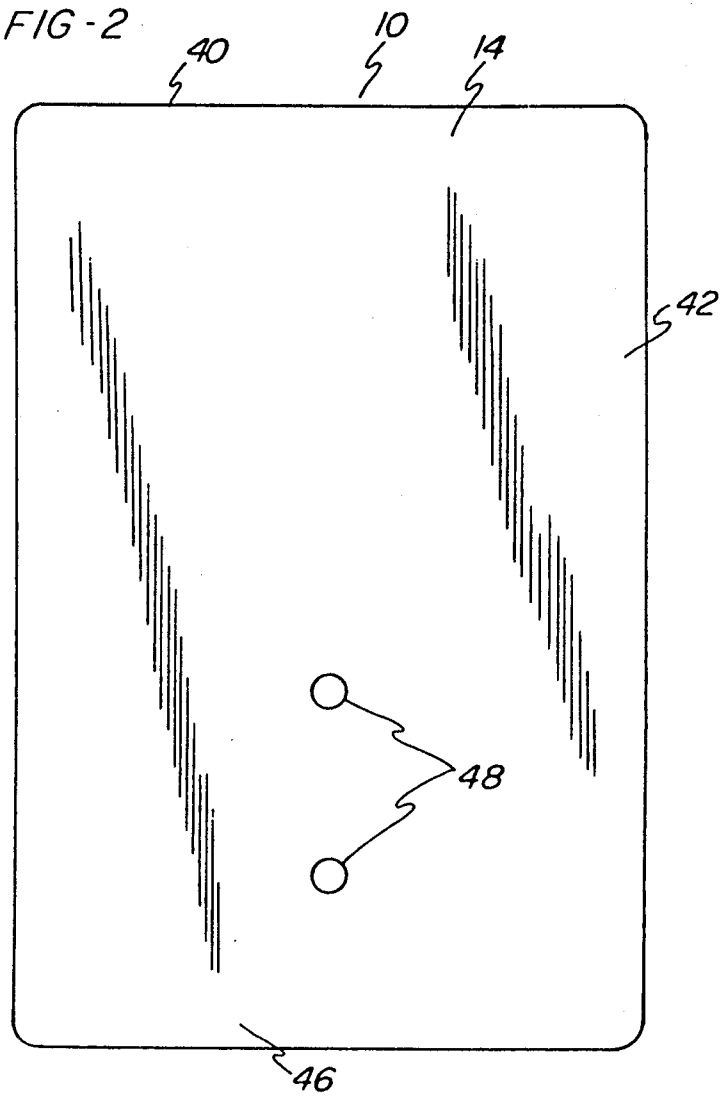
FIG. 2 is a rear elevational view of the envelope shown in FIG. 1.

Having reference now to FIG. 2, rear panel 14 similarly comprises a top edge 40, two side edges 42 and 44, and a bottom edge 46. Once again the top and bottom edges 40 and 46 respectively are preferably parallel to one another as are the side edges. The rear panel also comprises at least one aperture 48 as can be seen in FIG. 2. At least such apertures are provided. The rear panel also comprises an exterior surface 50 and an interior surface 52.

The front panel 12 and rear panel 14 are preferably secured to one another along the respective bottom edges of the two panels and along the side edges of the front panel which are secured to at least part of the side edges of the rear panel. It will also be noted that the entire peripheral edge 55 of the front exterior surface 30 and rear panel interior surface 52 are crimped as is shown in FIG. 1.

Figure 3:
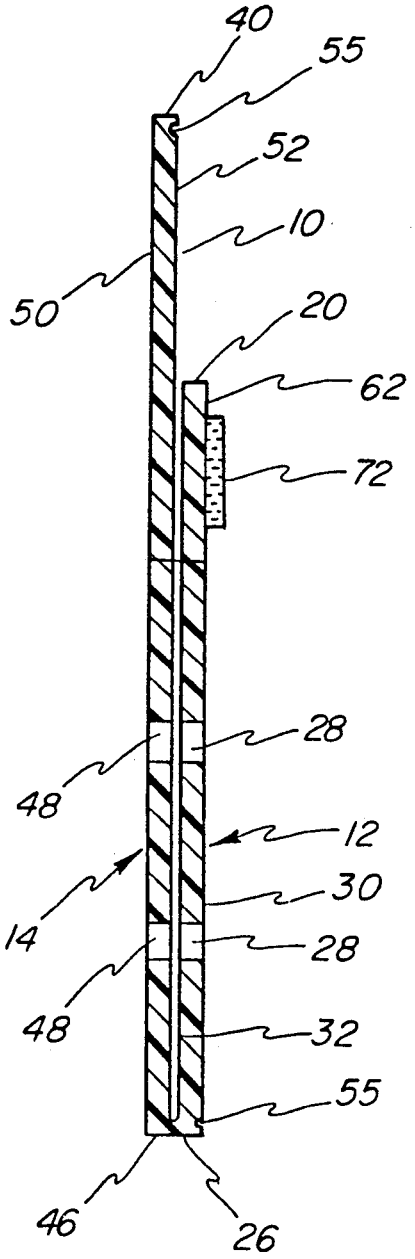
FIG. 3 is a vertical sectional view taken along line 3—3 of FIG. 1.

Comparing FIGS. 1, 2 and 3, it will be appreciated that any aperture associated with the front panel 12 is preferably aligned with the corresponding aperture in rear panel 14. As can also be seen in FIGS. 1 and 3, the front panel comprises first designation area 60 and second area designation area 62 separated by a vertical line 64, with the borders for the respective designations areas being the top edge 20, the side edges 22 and 24, and horizontal line 66. In the preferred embodiment of the invention a first designation 70 is placed in the first designation area 60. Also preferably, a second designation 72 is placed within the second designation area 62. For example, in the drawings, the first designation is "A" while the second designation is "01".

Figure 5:
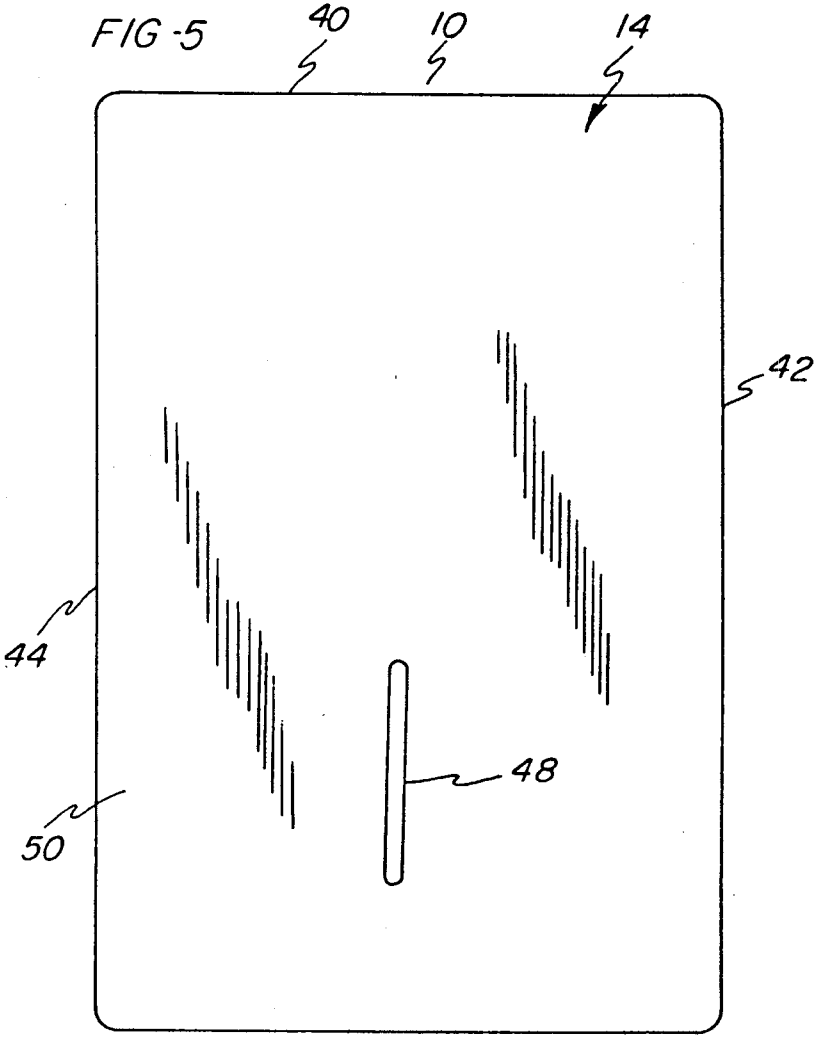
FIG. 5 is a rear elevational view of the embodiment of the invention shown in FIG. 4.
Figure 4:
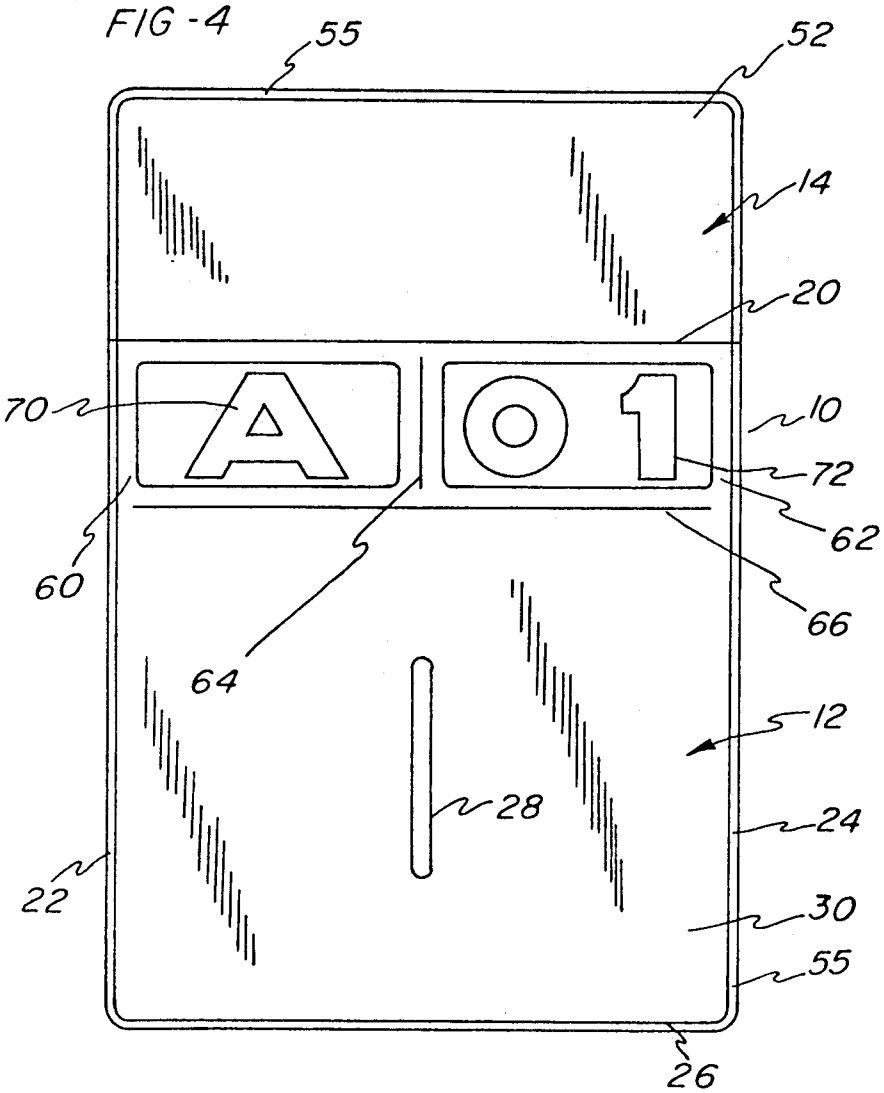
FIG. 4 is a front elevational view of a modified embodiment of the invention.

FIGS. 4 and 5 disclose a modified embodiment of the invention. As can be appreciated by the reference numerals associated with FIGS. 4 and 5, almost all of the components associated with this modified embodiment of the invention correspond to components shown in FIGS. 1-3. The most notable exception is with respect to the shape of aperture 28, 48. As can be appreciated from FIGS. 4 and 5, the shape of the aperture is elongated. It will also be noted that preferably the aperture extends vertically down the vertical center line associated with the front and rear panels.

Figure 7:
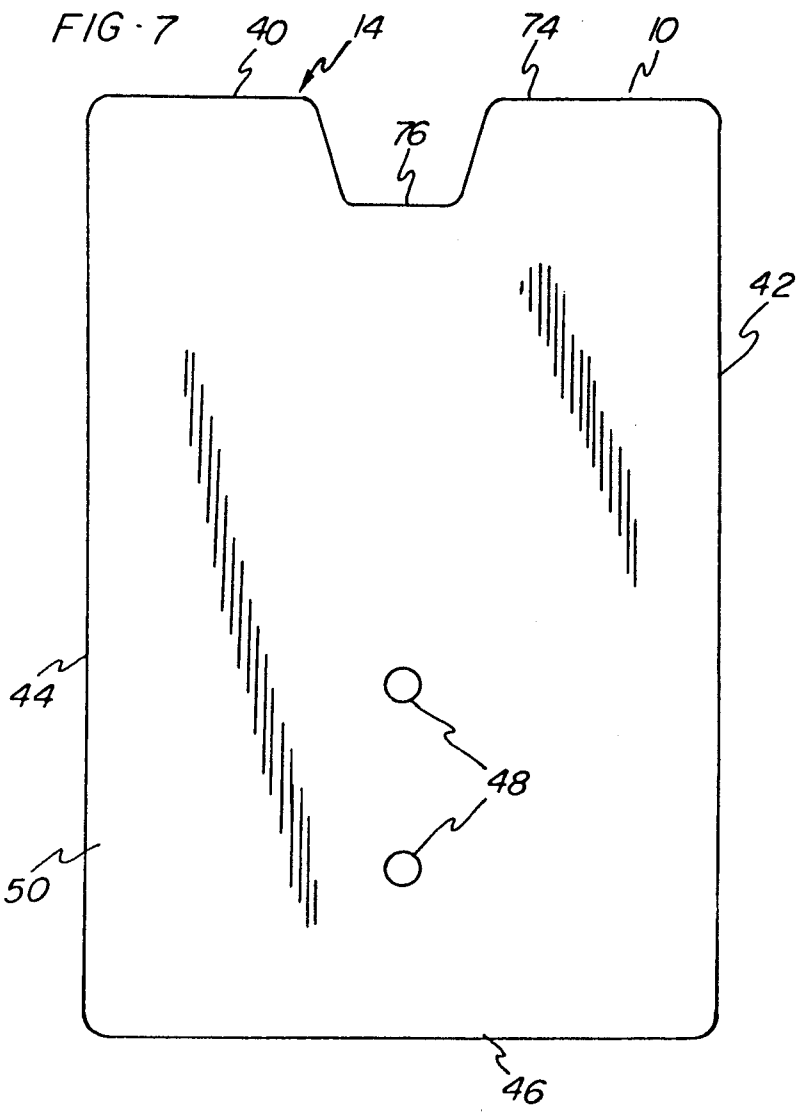
FIG. 7 is a rear elevational view of the embodiment of the invention shown in FIG. 6.
Figure 6:
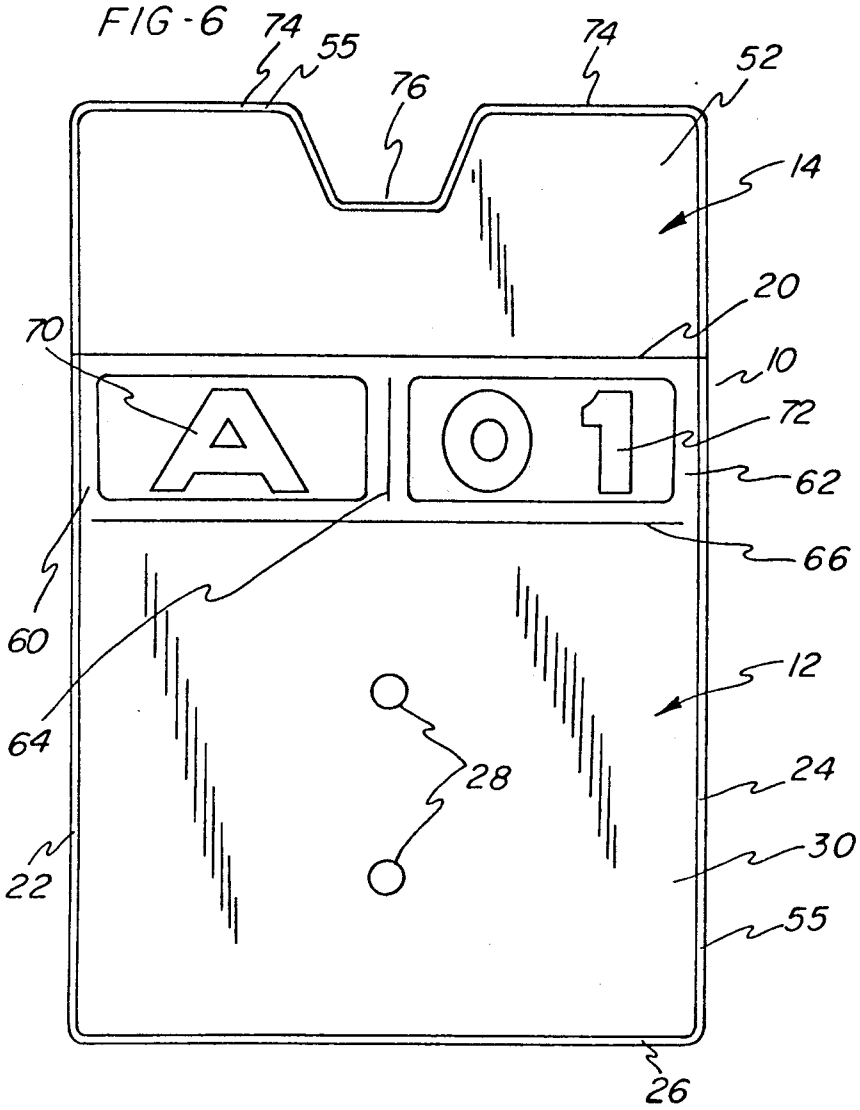
FIG. 6 is a front elevational view of the preferred modified embodiment of the invention.

FIGS. 6 and 7 disclose the preferred modified embodiment of the invention. Once again, most of the components of this embodiment are similar to those shown in the preceding drawings. The notable distinction to this embodiment is with respect to the notch-like indentation shown formed along the rear panel top edge. This notch-like indentation is preferably centered with respect to the rear panel vertical center line. The indentation extends part of the way down through the rear panel towards the top edge of the front panel as can be appreciated from FIG. 6, and assists in the easier and quicker removal of the cash deposits from the deposit envelope of this invention.

In each of the embodiments, the bottom edge of the front panel is spaced apart from the top edge of the front panel by a first distance, while the bottom edge of the rear panel is spaced apart from the top edge of the rear panel a second distance. In the preferred embodiment of the invention the second distance is greater than the first distance. Therefore, cash deposits placed in the improved envelope of this invention will project above the top edge of the front panel in overlaying relationship with respect to the protruding upper portion of the interior surface 52 of the rear panel 14.

As is the case with respect to the embodiment of the invention shown in FIGS. 1-3, the embodiments of the invention shown in the other drawing figures also have their apertures aligned with respect to the front and rear panels, and feature first and second designation areas and first and second designations. As can be seen, the front and rear panels are both approximately rectangularly shaped.

Preferably the improved deposit envelope of this invention is made of a soft, durable plastic or plastic coated paper such that the inventive envelope will not jam in safe openings, or be prone to ripping or tearing as do paper envelopes. Additionally, the limited amount of space between the front and rear panels provides for the secure retention of cash deposits within the envelope.

Preferably the total height of the rear panel is $6\frac{1}{2}''$, while the height of the front panel is $5\frac{1}{4}''$. The width of the envelope is preferably $3\frac{3}{4}''$. In the embodiments disclosing circular shaped apertures, preferably they are of a diameter of $\frac{3}{8}''$, while in the embodiment showing the elongated slot, preferably the slot is $1\frac{1}{2}''$ in length and $\frac{1}{8}''$ wide. In the embodiments disclosing two apertures, they are spaced apart $1\frac{1}{2}''$ from their respective centers, with the lowermost aperture also being spaced from the bottom edge by a distance of $1\frac{1}{2}''$ from its center. The top of the notch-like indentation is $1\frac{1}{2}''$ across, with the bottom being $\frac{3}{4}''$ across. The rear panel first edge portion 74 is preferably $\frac{3}{4}''$ above the rear panel top edge second edge portion 76.

In actual use, a plurality of the improved deposit envelopes of this invention are used with the deposit envelopes being labeled in the first and second designation areas so as to distinguish up to two of the factors associated with cash deposits. These factors include the time the deposit is made into the drop safe, the person responsible for the deposit such as the cashier, and the place responsible for the deposit, such as a particular register or an entire shift.

Preferably the first designation is used to designate the cashier, or register while the second designation is used to designate the time or number of deposit. Thus, in the drawing figures the first and second designations "A" and "01" could indicate, for example, that the cashier which corresponds to the letter "A" is making his or her first deposit. Or it could mean that cashier "A" was making the deposit for the first shift of the day. Still further, it could mean that a deposit from register "A" was being made at 1:00 p.m. The particular correlation between factors and designations can be varied based upon the user of this envelope system due to its flexible nature.

The presence of the apertures permits the user to make sure that all of the deposits are out of the envelopes. Similarly, the notch-shaped indentation permits easier grasping of the items retained in the deposit envelope when emptying and sorting the deposit envelopes.

The deposit envelope of this invention speeds up sorting and counting time. Additionally, it provides orderly accountability of cash deposits. Finally, its construction retains cash deposits securely while at the same time not being prone to malfunctioning or tearing when being deposited in drop safes.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. An improved deposit envelope comprising a front panel, said front panel comprising a first designation area and a second designation area, a top edge, a bottom edge spaced apart from said top edge a first distance, two side edges, an interior surface, and at least one aperture, said first and second designation areas being directly adjacent each other, and a rear panel, said rear panel comprising a top edge, a bottom edge spaced apart from said top edge a second distance, two side edges, an interior surface, and at least one aperture, said second distance being greater than said first distance, said rear panel having a notch-like indentation formed along said rear panel top edge, and said front panel secured along its sides to said rear panel such that all of said rear panel interior surface is always facing said front panel interior surface.

2. The improved deposit envelope according to claim 1 wherein said front panel aperture is aligned with said rear panel aperture.

3. The improved deposit envelope according to claim 2 wherein both said front panel and said rear panel have a vertical center line, said front panel aperture and said rear panel aperture being located along said vertical center lines.

4. The improved deposit envelope according to claim 1 wherein said front panel and rear panel each comprise two apertures.

5. The improved deposit envelope according to claim 4 wherein each of said front panel apertures are aligned with a respective rear panel aperture.

6. The improved deposit envelope according to claim 4 wherein said front panel and said rear panel have a vertical center line, said front panel apertures and said rear panel apertures being located along said vertical center line.

7. The improved deposit envelope according to claim 1 wherein said apertures are elongated.

8. The improved deposit envelope according to claim 4 wherein said apertures are elongated.

9. The improved deposit envelope according to claim 1 wherein said front panel comprises a first designation.

10. The improved deposit envelope according to claim 9 wherein said front panel comprises a second designation.

11. The improved deposit envelope according to claim 1 wherein said front panel and said rear panel are both rectangularly shaped.

12. The improved deposit envelope according to claim 3 wherein said rear panel has a notch-like indentation formed along said rear panel top edge, said notch-like indentation being located along said rear panel vertical center line.

13. The improved deposit envelope according to claim 1 wherein said notch-like indentation extends part of the way down through said rear panel towards said top edge of said front panel.

14. An improved deposit envelope comprising a front panel, said front panel comprising a first designation area and a second designation area, a first and second designation, a top edge, a bottom edge spaced apart from said top edge a first distance, two side edges, an interior surface, and at least one aperture, said first and second designation areas being directly adjacent each other, and a rear panel, said rear panel comprising a top edge, a bottom edge spaced apart from said top edge a second distance, said second distance being greater than said first distance, two side edges, an interior surface, and at least one aperture, said front panel aperture aligned with said rear panel aperture, said front panel and said rear panel both having a vertical center line, said front panel aperture and said rear panel aperture being located along said vertical center lines, said rear panel having a notch-like indentation formed along said rear panel top edge, and said front panel secured along its sides to said rear panel such taht all of said rear panel interior surface is always facing said front panel interior surface.

15. The improved deposit envelope according to claim 14 wherein said front panel and said rear panel are both rectangularly shaped.

16. The improved deposit envelope according to claim 14 wherein said rear panel has a notch-like indentation formed along said rear panel top edge, said notch-like indentation being located along said rear panel vertical center line.

17. The improved deposit envelope according to claim 16 wherein said notch-like indentation extends part of the way down through said rear panel towards said top edge of said front panel.

18. An improved deposit envelope comprising a front panel, said front panel comprising a first designation area and a second designation area, a top edge, a bottom edge spaced apart from said top edge a first distance, two side edges, an interior surface, and at least one aperture, said first and second designation areas being directly adjacent each other, and a rear panel, said rear panel comprising a top edge, a bottom edge spaced apart from said top edge a second distance, two side edges, an interior surface, and at least one aperture, said second distance being greater than said first distance, said rear panel having a notch-like indentation formed along said rear panel top edge, said front panel and said rear panel having a vertical center line, said front panel aperture and said rear panel aperture being located along said vertical center lines, said rear panel having a notch-like indentation formed along said rear panel top edge, said notch-like indentation being located along said rear panel vertical center line, and said front panel secured along its sides to said rear panel such that all of said rear panel interior surface is always facing said front panel interior surface.

19. The improved deposit envelope according to claim 18 wherein said apertures are elongated.

20. The improved deposit envelope according to claim 18 wherein said front panel comprises a first designation.

21. The improved deposit envelope according to claim 20 wherein said front panel comprises a second designation.

* * * * *